United States Patent [19]

Rikker

[11] 4,190,369

[45] Feb. 26, 1980

[54] METHOD AND APPARATUS FOR MAKING MOLDS

[75] Inventor: Leslie D. Rikker, Oak Forest, Ill.

[73] Assignee: National Engineering Company, Chicago, Ill.

[21] Appl. No.: 924,620

[22] Filed: Jul. 14, 1978

Related U.S. Application Data

[62] Division of Ser. No. 731,930, Oct. 13, 1976, Pat. No. 4,121,646.

[51] Int. Cl.[2] ..... B28C 5/16; B28C 7/06

[52] U.S. Cl. ..... 366/16; 366/34; 366/40; 366/65

[58] Field of Search ..... 366/27, 33, 34, 40, 366/64, 65, 168, 172, 173, 182, 171, 169; 425/134, 145, 375, 16

[56] References Cited

U.S. PATENT DOCUMENTS

| | | | |
|---|---|---|---|
| 2,309,036 | 1/1943 | Beardsley | 366/34 |
| 3,850,413 | 11/1974 | Rebish | 366/172 |
| 3,995,837 | 12/1976 | Parsonage | 366/172 |
| 4,039,169 | 8/1977 | Bartholomew | 366/64 |
| 4,126,398 | 11/1978 | Phillips | 366/168 |

*Primary Examiner*—Robert W. Jenkins
*Attorney, Agent, or Firm*—Mason, Kolehmainen, Rathburn & Wyss

[57] ABSTRACT

Apparatus of the invention includes a dispenser for mixing an discharging layers of the molding material onto the mold forming pattern, and means for producing selectively controlled relative movement between the dispenser and the pattern including a control system for varying the ratio of sand and binder in the mixture being dispensed in accordance with the relative position of the dispenser and the pattern. The apparatus may thus be controlled to provide for selectively variable ratios of sand and binder in accordance with the strength required of the mold at a particular position. The system also provides a selectively variable control of the thickness of each layer of molding material as the mixing head or pattern moves on a three axis coordinate system. For relatively small and light castings the mixing and dispensing head may be retained in a relatively fixed position while the pattern is selectively moved in a three axis coordinate grid while with large castings, the pattern is stationary and the mixing head is moved. The mixing and dispensing head is particularly designed for use in the field of "no-bake" sand-resin-catalyst mixing and includes facilities for controlling the mixing operation so that the mixture does not set up and harden in the mixing head between mixing operations. Also, the constituency of successive layers may be varied and the amount of organic binder material minimized so as to reduce smoke and fumes during the casting operation.

16 Claims, 12 Drawing Figures

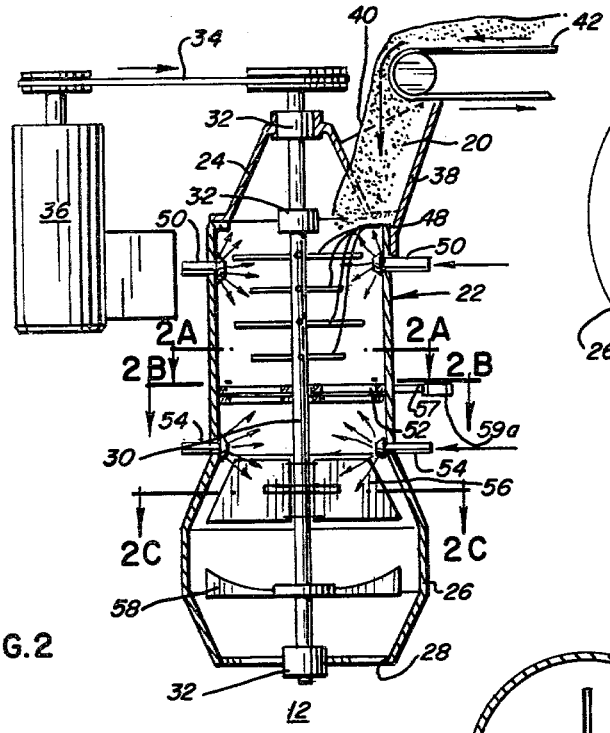
FIG.2
FIG. 2C
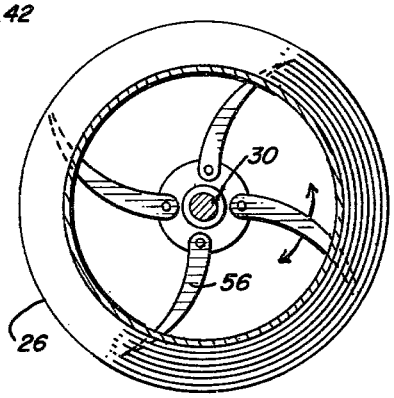
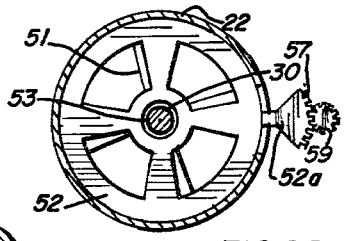
FIG.2B
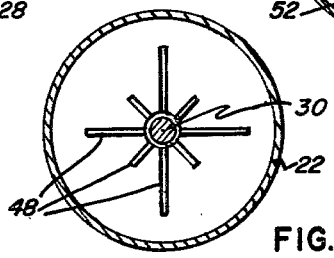
FIG. 2A
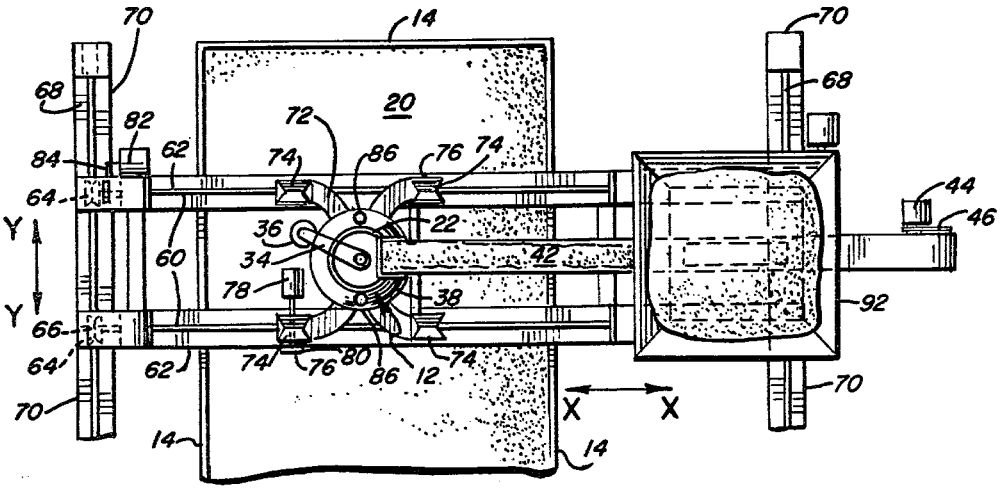
FIG. 4

METHOD AND APPARATUS FOR MAKING MOLDS

This is a division of copending application Ser. No. 731,930 filed Oct. 13, 1976, now U.S. Pat. No. 4,121,646.

BACKGROUND OF THE INVENTION

1. Field of the Invention

The present invention relates to a new and improved apparatus and method for making molds and encompasses both conventional or green sand molding processes and the newer process known as no-bake wherein the binder is a catalyzed plastic resin material rather than the conventional natural material binders commonly used in green molding.

One of the most common and economical metal forming techniques involves the pouring of molten metal into a preformed cavity called a mold wherein the metal then solidifies. After solidification, the mold is opened and the casting is removed or knocked out of the mold for further processing and the mold is destroyed in the process. Just as the characteristics of the liquid or molten poured into the mold cavity may vary dependent on the design of the particular casting, the molding material utilized in making the mold cavity may also vary widely. At the present time, the most commonly used molding material is silica sand and the silica sand grains are bound together to provide sufficient mold strength by many types of binding materials. In green sand molding, which is by far the most widely used method in molding metal castings, the binding material comprises a mixture of clay, water and bentonite and the silica sand and binder are treated in various types of equipment until a more or less homogeneous mold forming mixture of sand and binder is achieved. A mold cavity is then formed with this mixture by depositing the mixture over a pattern which is removed to form the cavity.

The sand and binder mixture should have a number of characteristics to be successfully used for high quality castings. The mold forming material must be flowable in order to readily fill the cavities and contours of the pattern needed. The material must have sufficient green strength to retain the cavity shape while the pattern is removed until the molten metal is introduced. The material must also have sufficient hot strength to contain the high temperature molten metal within the mold cavity and provide the needed dimensional accuracy while allowing for the escape of gases which develop as the molten metal flows into the mold cavity and cools. After cooling of the casting, the material must be readily destructable so that the finished castings can be removed or "knocked out". The spent molding material, for economical reasons, must also be reworkable or reclaimable for re-use in successive mold forming operations with a minimum of refinement and treatment being required.

It should be noted that some of the characteristics required are conflicting, for example, the needed hot strength of a mold to provide for good dimensional accuracy makes the mold much tougher to destroy and the "knock out" process is difficult after the casting process has been completed and the casting has cooled. In addition, the greater amount of binder added for producing hot strength make reclamation of the molding materials more difficult and more expensive. Because of these types of conflicts, a compromise in characteristics of the molding material is usually made because all of the desired characteristics are not achievable. These same problems are present with the more modern method of "no-bake" molding wherein a catalyzed plastic resinous material is used for binder with silica sand. In "no-bake" processes high mold strength is achieved but the process is considerably more expensive because of the relatively high cost of the plastic resin binders. Also, the "knock out" process is much more difficult and the material is not generally re-usable on an economical basis. Moreover, sometimes "no-bake" process molds do not readily permit the hot gases formed during the molding process to readily escape and thus, gas pockets develop in the castings. In addition, the dispensing apparatus used in the "no-bake" molding process is subject to clogging and other problems because the mixture sets up or hardens very quickly after the catalyst is added to the sand-resin mixture.

2. Description of the Prior Art

In prior art green sand molding systems the sand and binder are mixed in batches or continuously in a constant ratio to provide the necessary compromise characteristics needed for the mold. After mixing is completed, the material is deposited into a mold flask around a pattern and subsequently, the pattern is then separated from the mold. Usually a pair of mold flasks, called a cope and a drag, are coupled together to form the completed mold cavity. The characteristics of the molding sand mixture is usually constant for a given operation and hence certain parts of the mold may have more binder than is actually needed. This, of course, results in increased difficulty in the knock-out operation and in the reclamation process to re-use the same molding sand again after the castings are knocked-out and removed. Because of the complexity of making different or varying mixes of sand and binder for different portions of a mold to provide the different strength characteristics as required in the prior art systems a uniform mixture was usually established and used throughout. Because of this, many of the foregoing problems in green sand casting occurred.

In no-bake molding systems, only relatively small batches of sand and binder are mixed at one time because of the relatively short working time available before setting of the resin takes place. Once the resin is catalyzed, the batch of material has to be placed in the molds very quickly in order that the material does not set up before the mold is completed. Usually, the whole surface of the mold pattern is covered with the molding sand and catalyzed resin mix having a relatively uniform ratio of sand and resinous material and accordingly in areas where the mold strength required is not high, excess resin is wasted with the attendant economic loss and knock-out problems. Also, since a large amount of resinous material is present throughout the mold, the organic material in the binder cannot all be oxidized during the casting operation with the result that heavy vapor and fumes are produced during the casting operation which is obnoxious to the operators and from an air pollution standpoint.

It is therefore an important object of the present invention to provide a new and improved method and apparatus for making customized nolds.

More particularly, it is an object to provide a new and improved method and apparatus of the character described which eliminates or reduces one or more of the foregoing mentioned difficulties of prior art systems.

Yet another object of the present invention is to provide a new and improved program controlled customized method and apparatus for making molds wherein a layer of molding material comprising a mixture of sand and binder is dispensed over a mold forming pattern by relative movement between the pattern and the dispenser with the ratio of sand and binder automatically and selectively controlled and varied as needed in accordance with the relative position of the dispenser and the pattern. Thus, in areas on the pattern where high stress occurs in the mold, more binder or resin is mixed with the sand and in other areas where the mold strength requirement is reduced, lesser amounts of binder or resin are utilized. This results in economic savings all the way down the line in producing finished castings.

Yet another object of the present invention is to provide a new and improved program controlled, customized method and apparatus for making molds of the character described wherein the thickness of the layer of mold forming material deposited on the surface of the pattern is automatically controlled and can be varied at different positions over the mold forming pattern in accordance with the strength required at a particular point on the pattern surface.

Still another object of the invention is to provide a new and improved method and apparatus of the character described wherein the ratio of molding sand and binder is selectively controlled and variable in response to the point of application of the molding mixture onto the surface of the pattern used for forming the mold cavity.

Still another object of the present invention is to provide a new and improved method and apparatus of the character described wherein a programmed control system of the tape or drum controlled type is provided for selectively and variably controlling relative movement between a molding material dispenser and a mold forming pattern as well as the ratio of sand and binder being deposited at any particular location.

Still another object of the present invention is to provide a new and improved method and apparatus of the character described wherein the relative position of a molding material dispensing device and a mold forming pattern surface are automatically controlled in a plural axis coordinate system and the thickness of the deposited layer of molding material is also automatically controlled.

Another object of the present invention is to provide a new and improved apparatus and method of the character described wherein either a molding material dispensing device is movable relative to a fixed mold forming pattern surface or vice versa.

Another object of the invention is to provide a new and improved mold having an inner layer formed of molding material including a wetting agent for improving the surface of the material being cast and reducing the amount of mold material tending to stick to the casting after the knock-out process and having succeeding layers around the inner layer without said wetting agent.

Yet another object of the invention is to provide a new and improved mold having an inner first layer forming a mold cavity comprising a mixture of sand and organic binder of a thickness such that substantially all of the binder is oxidized by the heat received from the molten material cast in the cavity and having successive layers around said inner layer comprising a mixture of sand and inorganic binder.

Yet another object of the invention is to provide a new and improved continuous mixer for molding material including a first portion for mixing sand and uncured resin binder and a second portion for mixing catalyst with said and uncured binder.

Yet another object of the invention is to provide a new and improved continuous mixer as in the preceeding object including a controllable metering plate for controlling the flow between said first and second portions of said mixer.

A further object of the present invention is to provide a new and improved method and apparatus of the character described wherein the successive layers of molding material which are automatically deposited on the pattern may have different organic or inorganic binders so as to facilitate knock-out and reclaiming of the mixture and to minimize smoke and fumes during the casting process.

Still another object of the present invention is to provide a new and improved method and apparatus of making molds of the character described wherein program controlled apparatus is provided for forming molds in a highly accurate and repeatable manner.

SUMMARY OF THE INVENTION

The foregoing and other objects and advantages of the present invention are accomplished by providing a dispenser for mixing and discharging successive layers of molding material onto the surface of a mold forming pattern mounted in a mold flask. An automatic control system is provided for producing controlled relative movement between the dispenser and the pattern and including facilities for varying the ratio of sand and binder being deposited onto the pattern from the dispenser in accordance with the mold strength needed for the mold cavity at any particular position on the casting surface. This automatic control system may be of the type shown in Forrester et al U.S. Pat. No. 3,069,608 wherein digital representations are provided on a control tape in which successive blocks of information correspond to desired increments of movement in a plural axis coordinate system, the details of the control system disclosed in this patent being incorporated herein by reference. Briefly stated, in such a control system a clock oscillator is employed to develop a series of pulses which are then supplied to a linear interpolator which in response to numerical commands read from the tape produces separate streams of pulses for each controlled axis which are uniformly spaced in time and quantitatively represent the desired increment of movement in that axis. These separate pulse streams are then utilized to control movement in each axis so that a desired path in space is achieved. If a curved path is desired it is achieved by programming a series of closely spaced straight line segments which approximate the desired curve to a predetermined degree of accuracy.

The mixing and dispensing apparatus of the present invention is particularly suited for use in the no-bake type of process and includes facilities for separately supplying controllable amounts of resin and catalyst to the mixing chamber. To this end, the volume of sand supplied to the mixing chamber is continuously measured and this measurement is employed in conjunction with a ratio number obtained from the system control tape or drum to control the amount of resin supplied to the mixing chamber at any particular instant. A similar arrangement is employed to control the amount of catalyst supplied to the mixing chamber at any particular instant. The dispensing apparatus also includes facilities for mixing the sand, resin and catalyst in a vertically arranged self-draining mixing chamber and means are provided for shutting off the supply of sand and resin mixture ahead of the point where the catalyst is introduced so that the mixing apparatus can be shut down without clogging due to setting of the sand-resin-catalyst mixture. The control system also provides for automatically controlling the thickness of each layer of molding mixture deposited on the pattern by the dispenser. Control of layer thickness may be obtained by means of a feed rate number obtained from the system control tape or drum in which case layer thickness may be varied at different locations on the pattern by varying the velocity of movement of the mixing head in these areas. In the alternative the velocity of the mixing head may be controlled at the start of each pass over the pattern by manually adjusting the frequency of the clock which supplies control pulses to the linear interpolator portion of the automatic control system.

BRIEF DESCRIPTION OF THE DRAWINGS

For better understanding of the invention, reference should be had to the following detailed description taken in conjunction with the drawings in which:

FIG. 2 is an enlarged, vertical cross-sectional view of a mixing head dispenser of the apparatus depicted in FIG. 1;

FIG. 2A is a horizontal, cross-sectional view taken substantially along lines 2A—2A of FIG. 2;

FIG. 2B is a horizontal, cross-sectional view taken substantially along lines 2B—2B of FIG. 2;

FIG. 2C is a horizontal, cross-sectional view taken substantially along lines 2C—2C of FIG. 2;

FIG. 4 is a top plan view of the apparatus of FIG. 1;

DESCRIPTION OF THE PREFERRED EMBODIMENTS

Figure 1:
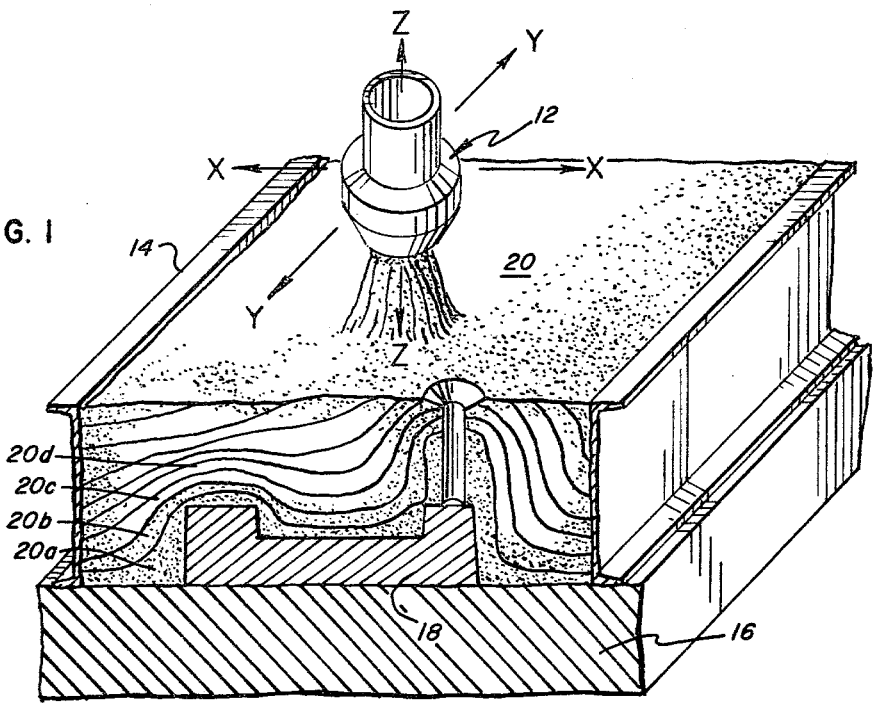
FIG. 1 is a schematic perspective view of a new and improved apparatus for the customized making of molds constructed in accordance with the features of the present invention.

Referring now more particularly to FIGS. 1-5 of the drawings, therein is illustrated a new and improved program controlled apparatus for making customized molds constructed in accordance with the features of the present invention and referred to generally by the reference numeral 10. As viewed somewhat schematically in FIG. 1, the mold making apparatus 10 includes a movable mixing head dispenser 12 which is adapted to discharge a downwardly directed stream of molding material of predetermined cross-section into a mold flask 14 mounted on a fixed or movable platen 16. A mold cavity forming pattern 18 of the shape of the casting is mounted in the mold flask to form the shape of the mold cavity in the molding material 20 dispensed into the flask in successive layers of molding material **20*a*, 20*b*, 20*c* of selectively controlled, variable characteristics and thickness which are deposited on the surface of the pattern until the mold flask is filled to the desired level. Relative movement between the dispenser head 12 and the pattern 18 is provided by the automatic control system of the present invention described in more detail hereinafter, so that the flask is filled by deposition of successive layers of material on the surface of the pattern by movement of the dispensing head in a precision controlled manner measured on a coordinate system relative to horizontal axes "X" and "Y" and a vertical axis "Z" all at right angles to each other. In this connection, the dispensing head 12 may be moved over the mold flask 14 in any desired manner such that a layer of desired thickness is deposited over the pattern. For example, the dispensing head 12 may be moved back and forth across the flask 14 in parallel paths which are spaced apart by an amount determined by the width of the stream of molding material issuing from the head 12 so that a layer of uniform thickness is applied to the pattern. In addition, the dispenser head is controllable to move up and down as measured along the vertical axis "Z" so that the distance of travel from the lower outlet end of the dispenser to the surface of the mold pattern 18** may be variably selected and controlled. Also, the velocity of movement of the dispenser head along one of the paths may be selectively varied, as will be described in more detail hereinafter.

Referring now to FIGS. 2, 2A, 2B and 2C, the dispenser head 12 includes a generally cylindrical mixing chamber 22 having a frustroconical upper end portion 24 and an enlarged lower end portion 26 with an open lower end forming a discharge outlet 28 for dispensing the molding material over the pattern 18. The mixing head is provided with a vertical rotor shaft 30 supported in a plurality of bearings 32 and is driven with a V-belt drive 34 at the upper end of the mixing head powered by an electrical motor 36.

Silica sand for the molding material is delivered into a hopper section 38 in communication with an inlet opening 40 in the frustroconical upper end portion 24 of the dispenser as best shown in FIG. 2 and the sand is supplied by means of an endless belt conveyor generally indicated by the reference numeral 42. The belt conveyor is powered by an electrical motor 44 through a V-belt drive 46 and the motor is of a type having an electronic speed control so that the flow rate of sand to the mixing head may be selectively controlled and varied. Similarly, the motor 36 on the dispenser head is of the type including an electronic speed control so that the speed of the rotor shaft 30 in the mixing head may be selectively controlled and varied as desired, and integrated with the speed or rate of flow of silica sand delivered into the mixing chamber by the belt conveyor 42.

In the intermediate level of the mixing chamber 22, the rotor shaft 30 is provided with a plurality of radial mixing elements 48 (FIG. 2A) of different lengths and at several levels, and these mixing elements retard the downward flow of sand within the chamber so that the sand remains suspended for an interval for thorough mixing of the sand with a plastic resin binder. An uncured plastic resin binder such as a furfuralcohol resin is introduced into the mixing chamber at an upper level therein through one or more resin injection nozzles 50 and the nozzles spray the resin in small droplets for intimate intermixing with the downwardly flowing sand in the chamber which is moved in a rotary swirling pattern by the mixing elements 48. After the resin and sand are intermixed thoroughly, the mixture flows into a lower portion of the chamber where a catalyst is introduced for curing the resin. The catalyst is introduced through one or more spray nozzles 54 at a level just above the enlarged area section 26 and when the catalyst is mixed with the resin and sand mixture, the resin starts to cure, and fast intimate mixing is desired. For this purpose, the enlarged lower chamber section 26 is provided with a fan-like mixing element 56 carried on the rotor shaft just below the level of catalyst injection nozzle 54. The fan-like mixing element 56 includes a plurality of impellers separately hinged and attached to a collar on the rotating shaft 30. And these impellers force the sand resin mixture outwardly towards the wall of the enlarged section 26 of the mixing chamber and act as spatulas to spread the catalyst thoroughly in the sand-resin mixture. The downward movement of the mixture is accellerated by the sloped surface of the impellers and the completed mixture of catalyzed resin and sand is then discharged downwardly in a flowing stream onto the surface of the mold pattern 18 mounted in the mold flask 14 therebelow. If desired, an additional sand slinging blade 58 may be mounted adjacent the lower end of the rotor shaft 30 to more forcefully expel the sand and catalyzed resin mixture outwardly through the discharge opening 28 to more uniformly cover a predetermined path on the surface of the pattern 18 in the flask.

In order to contain the sand-binder mixture within the upper portion of the mixing chamber 22 so that proper mixing action may be obtained and a predetermined flow of material maintained, a slotted disc 51 is positioned across the mixing chamber 22 and is provided with a clearance opening 53 at the center thereof for the shaft 30. A cooperating slotted metering plate or disc 52 is positioned above the disc 51 and is rotatable with respect to the fixed disc 51 so that the cooperating openings therein may be closed or opened more widely by rotation of the metering plate 52. To this end an arm **52*a* on the plate 52 extends through a slot 55 in the wall of the chamber 22 and is provided with a gear segment 57 which is arranged to be driven by the pinion gear 59 so as to rotate the plate 52 relative to the disc 51**.

The details of the arrangement for controlling movement of the disc 52 will be described in more detail hereinafter. However, it should be noted that the metering plate 52 is positioned above the injection nozzle 54, i.e. the point at which a catalyst is introduced into the sand-binder mixture. Accordingly, the plate 52 may be closed off so as to prevent the sand and binder mixture from flowing downwardly into the area where the catalyst is introduced when it is desired to shut down the apparatus. The sand-binder mixture which does contain catalyst below the slotted plate 52 simply falls out of the lower portion 26 of the head 12 so that no catalyzed sand-binder mixture remains in the mixing chamber which could harden and clog up the mixing chamber 22 once the apparatus has been shut down.

Figure 5:
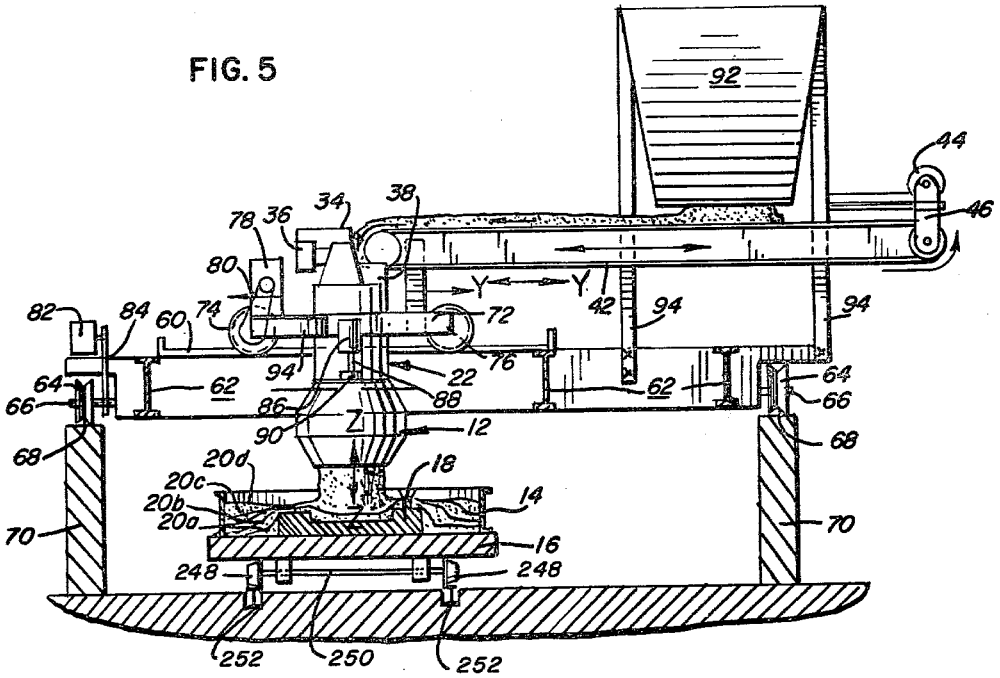
FIG. 5 is a vertical elevational view with portions in section of the apparatus of FIG. 1.
Figure 6:
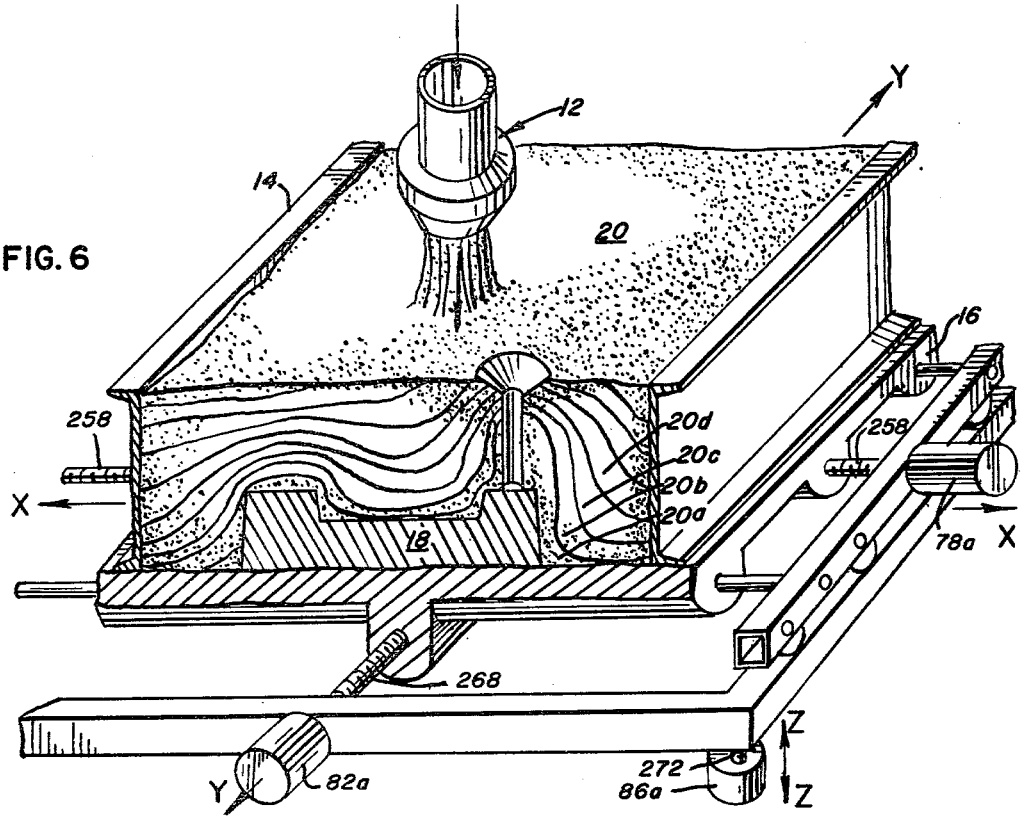
FIG. 6 is a schematic perspective view similar to FIG. 1 of another embodiment of the apparatus constructed in accordance with the features of the present invention.

In order to provide controlled relative movement between the dispensing head 12 and the mold forming pattern 18 contained in the mold flask 14, the dispensing head is supported on a frame 72 mounted for rolling movement along the X—X axis on a pair of parallel guide rails 60. The guide rails are mounted on a rectangular frame or carriage 62 which is movable in a transverse direction on a horizontal Y—Y axis at right angles to the horizontal X—X axis. The carriage 62 is provided with pairs of rolls 64 carried on axles 66, as best shown in FIG. 5 and the rolls ride on a pair of elongated parallel tracks 68 which are mounted on spaced apart trunnion bases 70 disposed on opposite sides of the platen 16 on which the mold flask and pattern are supported. The dispenser head 12 is supported for vertical movement along the Z—Z axis on frame 72 and is selectively adjustable thereon to provide for the desired clearance or spacing between the lower outlet 28 and the upper surface of mold forming pattern 18. The frame 72 is provided with a plurality of rolls 74 carried on axles 76 and the rolls ride on the rails 60 of the carriage 62.

In order to control the relative position of the dispenser head 12, on the carriage 62 with respect to the horizontal axis X—X, at least one of the roll axles 76 is powered with an X-axis servomotor 78 connected with the axle by a suitable drive train 80. Similarly, positioning of the dispenser head relative to the pattern 18 in the Y axis is selectively and variably controllable by means of a servomotor 82 interconnected to one or more of the drive axles 66 through a suitable drive train 84. The servomotor 82 moves the carriage 62 back and forth along the rails 68 parallel to the Y—Y axis while the servomotor 78 moves the frame 72 along the rails 60 of the carriage parallel to the X—X axis. The mixing head 12 is movable in a vertical direction with respect to the Z—Z axis by means of a servomotor 86 drivingly interconnecting the mixing chamber 22 and frame 72 by means of threaded screw 88 and a bracket 90 as shown in FIG. 5. From the foregoing it will be seen that the servomotors 78, 82 and 86 provide precision driving power for moving the mixing head 12 over the mold forming pattern 18 to precise positions and at selectively controllable rates of movement.

Figure 3:
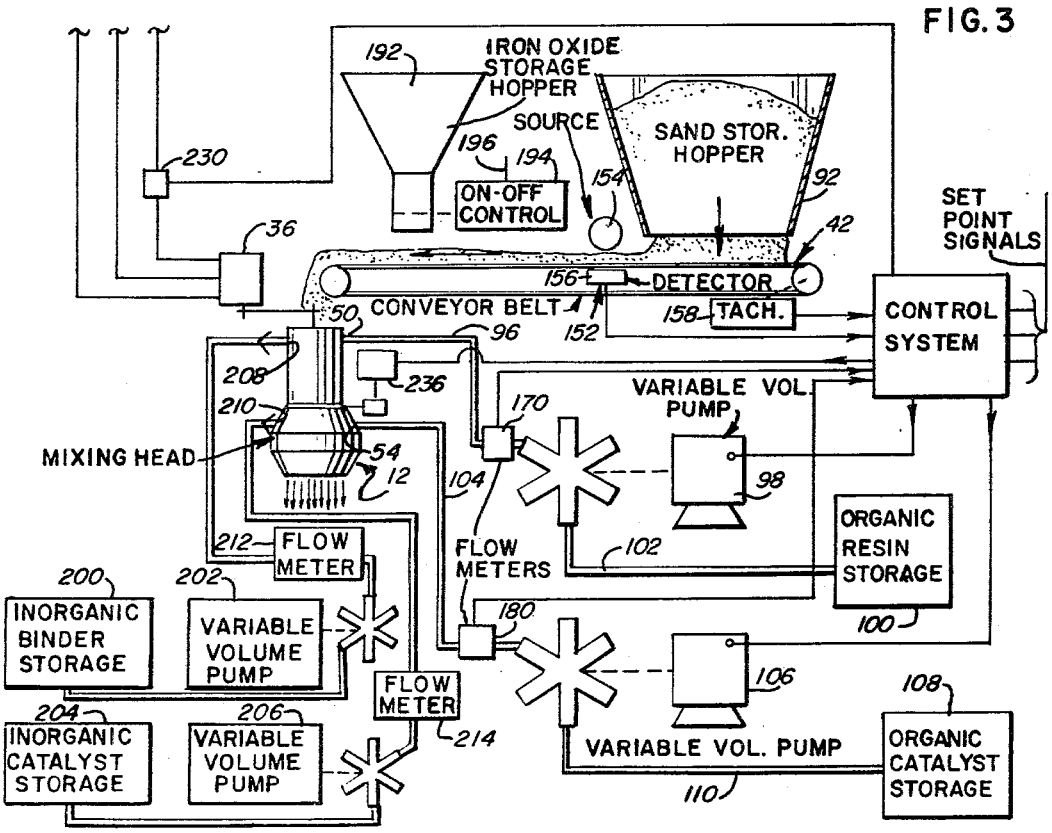
FIG. 3 is a block diagram of the process control system portion of the automatic control system of the present invention, including components of the control system for controlling the mixing head dispenser.

Silica sand for the molding material is supplied to the belt conveyor 42 from a hopper 92 having a lower outlet discharging sand directly onto the belt which underlies the hopper. The hopper is supported on uprights 94 for movement with the carriage 62. The liquid resin is supplied to one of the resin inlet nozzles 50 through a flexible resin line 96 (FIG. 3) connected to the output side of a variable volume resin pump 98. Resin is supplied to the pump from a resin storage tank 100 through a tank supply line 102. Similarly, the catalyst is supplied to one of the catalyst injection nozzles 54 via a flexible catalyst supply line 104 connected to the output side of a variable volume catalyst pump 106. The catalyst pump is in turn supplied from a storage reservoir 108 via a supply line 110 as shown in FIG. 3. The resin and catalyst storage tanks may be mounted for movement with the carriage 62 or may be stationed at a fixed location adjacent the apparatus 10. All of the resin and catalyst lines 96, 102, 104 and 110 are flexible lines to provide for the relative movement of the mixing head 12.

In accordance with the present invention, movement of the mixing head dispenser 12 relative to the mold forming pattern 18 is controlled by a numerical control system which may be of the type as shown and described in Forrester et al U.S. Pat. No. 3,069,608 and this numerical control system is coordinated with control of the resin pump 98 and catalyst pump 108 and the flow of molding material through the mixing chamber 22 to deposit the above-described layers of molding material into the flask 14. More particularly, this automatic control system includes a tape reader 112 (FIG. 7) which is arranged to read successive blocks of information derived from a suitable control medium such as the punched tape shown in FIG. 8. The output from the tape reader 112 is supplied to a buffer storage register 114 and as the next block of information is read from the tape 113, the information stored in the buffer register 114 is advanced and stored in an active storage register 116.

Each block of information on the tape 113 includes a series of numerical representations corresponding to a desired increment of movement in the X, Y and Z axes as well as a numerical representation of the desired direction of movement in each axis. In addition, each block of information includes numerical representations corresponding to the desired volume or flow of resin to the mixing chamber during the period while the mixing head is being moved over the prescribed distance, as well as numerical representations corresponding to a desired volume or flow of catalyst to the mixing chamber 22.

In addition, the tape 113 may include a numerical representation corresponding to a desired velocity of the dispensing head 12 in each of the X, Y and Z axes. The punched tape 113 may also include further information relating to the supply of molding material to the head 12, as will be described in more detail hereinafter.

The numerical representations which are stored in the active storage register 116, which are usually in binary coded decimal form, are supplied to a linear interpolator 118 which is arranged to receive a series of clock pulses from a clock oscillator 120. The linear interpolator responds to the numerical values supplied to it from the active storage register 116 by developing separate streams of command pulses on the output lines 122, 124 and 126 thereof corresponding to the X, Y and Z axes respectively. More particularly, the linear interpolator provides a stream of command pulses on the output line 122, each of which corresponds to a predetermined increment of movement in the X axis, these command pulses being equally spaced apart in time and quantitatively representing the distance to be moved in the X axis. In a similar manner, separate streams of pulses on the lines 124 and 126 correspond to the distance to be moved in the Y and Z axes.

The command pulses on the lines 122, 124 and 126 are supplied to pulse-code-to-analog servomechanisms 128, 130 and 132 for the X, Y and Z axes, respectively. As described in more detail in Forrester et al U.S. Pat. No. 3,069,608, each pulse code to analog mechanism includes a reversible binary counter (identified as the summing register 140 in said Forrester et al U.S. Patent) to one input of which the command pulses are supplied, a decoder for converting the coded error output signal of the summing register into an analog signal, an amplifier and servomotor for driving an output snychro, a position encoder mechanically connected to the synchro shaft, and a position code converter for converting movement of the position encoder into a series of response pulses which are fed back to the summing register to subtract from the count produced therein by the command pulses. The synchro output of the pulse-code-to-analog servomechanism is then employed to control the drive servomotor for each of the respective controlled axes. Thus, the pulse code to analog mechanism 128 is employed to control the movement of the X axis servomotor 78. The pulse-code-to-analog servomechanism 130 is employed to control movement of the Y axis servomotor 82, and the pulse-code-to-analog servomechanism 132 is employed to control movement of the Z axis servomotor 86.

It is pointed out that the command pulses may be employed to control movement of the mixing chamber 22 in the respective axes with other types of arrangements. For example, an open loop type of system wherein stepping motors for each of the X, Y and Z axes are controlled directly from their respective command pulses through suitable buffer amplifiers and the like may be employed to control movement of the dispensing head 12, as will be readily understood by those skilled in the art.

Considering now the manner in which numerical information is included on the punched tape 113 to control movement of the dispenser head 12 and variations in the sand-binder ratio of the molding sand mixture developed by the dispensing head 12, it is pointed out that each block of information on the tape 113 includes a series of transverse rows of information which are successively read by the tape reader 112 and stored in the buffer storage register 114. In the illustrated embodiment in FIG. 8, each row of information comprises three binary digits to the right of the sprocket holes 134 and five binary digits to the left of these sprocket holes.

The quantity represented by each transverse row of binary information on the tape 113 is shown immediately adjacent the righthand edge of the tape and it will be seen that the first rows of information in each block on the tape 113 consist of a series of binary coded distances and directions to be moved in the X, Y and Z axes. In this connection it will be understood that representation of a desired increment of movement in the X, Y and Z axes may be provided in any other suitable manner on either a magnetic tape or a punched paper tape, as will be understood by those skilled in the art.

Figure 8:
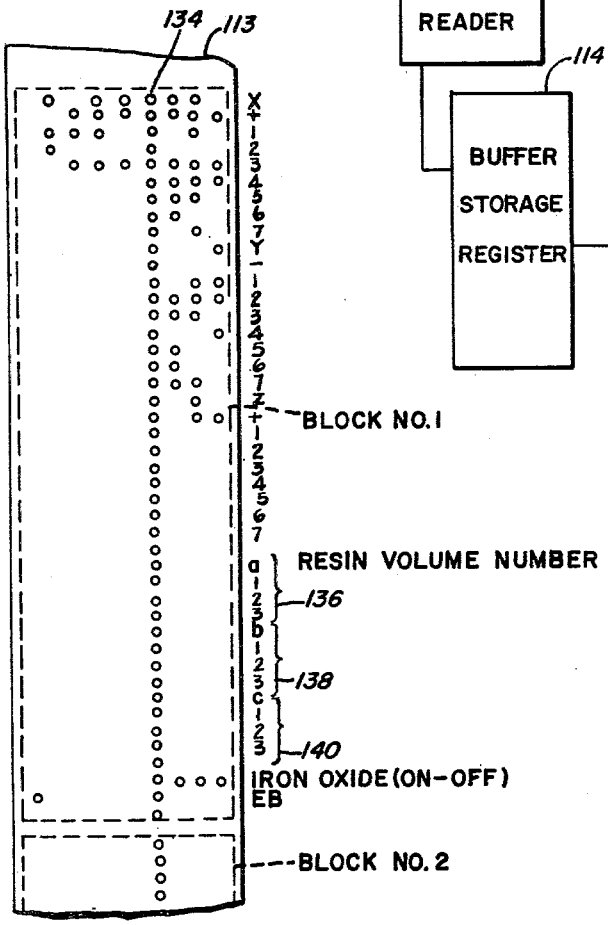
FIG. 8 is a diagrammatic representation of a control tape for the automatic control system of the present invention.

Following the X, Y and Z axes information, a series of transverse rows of information, indicated collectively as the sub-block 136 in FIG. 8, are provided on the tape 113. The first row of information in the sub-block 136 identifies the succeeding rows as relating to a desired volume of resin flow during the period of movement represented by the X, Y and Z information and the succeeding rows in the sub-block 136 constitute a desired numerical command or set point signal which is employed to control resin flow in a manner to be described in more detail hereinafter. Immediately following the resin flow block 136 a second block of transverse rows indicated at 138 is provided on the tape 113 and identifies a block of information as catalyst volume flow, the last three rows in this group providing a numerical command or set point valve corresponding to a desired catalyst flow.

Following the catalyst volume information, a third sub-block 40 is provided on the tape 113 which includes a transverse row identifying the information as relating to a desired maximum velocity or feed rate in the X, Y and Z axes, the succeeding three rows of information in the sub-block 140 providing a numerical velocity numer which is employed to control movement of the dispensing head 12.

Following the sub-block 140 a single row of information provides on-off information for the addition of iron oxide to the sand-binder mixture, as will be described hereinafter in more detail. The last row of information on the tape 113 is an end of block signal which controls the tape reader 112 to stop reading information until the dispenser head 12 has been moved the designated distance in the X, Y and Z axes.

The linear interpolator 118 consists of a series of divider stages which are controlled spirally one after the other from the clock pulses which are supplied by the clock oscillator 120. When the last divider stage in the linear interpolator 118 is reset, a control signal is supplied over the line 142 to the tape reader 112 so as to enable the tape reader 112 to read the next block of information from the tape 113. Since each block of information is automatically stored in the buffer storage register 114 while the information stored in the active register 116 is being utilized by the linear interpolator 118 to produce command pulses, continuous motion of the dispenser head 12 is achieved despite the discontinuous mode of reading information from the tape 113, as described in detail in said Forrester et al U.S. Pat. No. 3,069,608.

Considering now the manner in which the numerical information on the tape 113 relating to resin and catalyst flow, etc. is employed to control the operation of the mixing chamber 22, it is first pointed out that this numerical information is supplied to a control system which is similar to a conventional process control system and is employed to control the flow of resin and catalyst to the dispensing head 12 and adjustment of the metering plate 52. More particularly, the numerical information which is stored in the active storage register 116 is supplied to a multi-channel digital to analog converter indicated generally at 144. Each channel of the converter 144 provides a suitable analog control signal or set point signal corresponding to the numerical information in one of the sub-blocks on the tape 113. Thus, an analog organic resin volume control signal is developed on the output conductor 136 of the converter 144, an organic catalyst flow analog control signal is developed on the output conductor 148 thereof and an analog velocity signal is supplied on the output conductor 150.

Since the flow of sand from the hopper 92 is not necessarily uniform, it is necessary first to develop an electrical signal corresponding to volume of sand which is supplied to the hopper portion 38 of the dispenser head 12 at any given instant. To this end, a sand density detector indicated generally at 152 is provided continuously to measure the density of sand supplied to the conveyor 42 from the hopper 92. The density detector 152 may, for example, comprise a suitable source of gamma rays 154 which is located above the upper run of the conveyor 42 and a gamma ray detector 156 located below the conveyor belt in such manner that the number of gamma rays received by the detector 156 per unit of time is a measure of the density of the intervening sand on the conveyor belt. In the alternative, any other suitable arrangement may be employed for determining the density of the sand on the conveyor belt 42.

The velocity of the conveyor belt 42 is also determined by means of a tachometer 158 which develops an electrical output signal corresponding to the velocity of the conveyor 42, as will be readily understood by those skilled in the art.

The output signals from the sand density detector and the conveyor tachometer 158 are supplied to a multiplier 160 which may be in the form of an electronic module such as used in conventional process control system equipment and the output signal 162 of the multiplier 160 comprising an analog electrical signal equal to the product of the two analog input signals. This product represents the volume of sand supplied to the dispenser head 12 per unit of time.

The output 162 from the multiplier 160 is supplied as one input to a divider module 164 to the other input of which is supplied the organic resin set point signal developed by the digital to analog converter 144 on the line 146. The coded resin volume number in sub-block 136 on the tape 113 is in the form of a fraction representing the desired percentage of resin which is to be added to the sand at a particular location within the flask 14 to provide a desired strength of the mold at that particular location. In this connection, it will be understood that the resin volume number, i.e. the sun-block 136 on the tape 113, may vary with successive blocks of information so that the resin flow from the nozzle 50 is varied at different locations within the mold flask thereby providing different ratios of sand-to-binder at different desired locations in the mold.

The divider module 164 develops an analog output signal on the output conductor 166 thereof which is proportional to the resin set point signal developed on the conductor 146. For example, if the sand volume signal appearing on the conductor 162 is five volts and two percent of organic resin is to be added in the mixing chamber 22, the output signal from the divider module 164 on the conductor 166 will be 0.10 volts. This 0.10 volt signal is supplied to a resin flow controller 168, the output of which is employed to control the setting of the variable volume resin pump 98. In order to provide feedback information for the resin flow controller 168, a resin flow meter 170 is provided in the output line of the pump 98 and develops an electrical feedback signal which is supplied over the conductor 172 to the input of the resin flow controller 168. Accordingly, the volume of resin pumped by the pump 98 per unit of time varies in response to the resin volume number on the tape 113. In this connection, it will be understood that the resin and catalyst numbers on the tape may be in terms of a percentage of the weight of the sand per unit of time rather than a percentage of the sand volume.

Since the amount of catalyst needed is dependent upon the amount of resin being used at any particular instant, it is necessary to control the flow of catalyst in accordance with the control signal supplied to the resin flow controller 168. To this end, the output signal from the divider module 164 is supplied as one input to a divider module 174 to the other input of which is supplied the catalyst set point or control signal developed by the converter 144. If, for example, it is desired to use a volume of catalyst flow equal to thirty percent of the resin flow the output from the divider module 174 will provide a 0.033 volt signal on the output conductor 176 thereof (assuming an output signal of 0.10 volts from the divider 164 as in the above example).

The output of the divider module 174 is supplied to an organic catalyst flow controller 178 which controls the catalyst pump 106. A catalyst flow meter 180 is provided in the output line of the pump 106 and produces a feedback signal which is supplied over the conductor 182 to the other input of the catalyst flow controller 178. Accordingly, the pump 106 is adjusted to provide a flow thirty percent as large as the volume of the resin flow and this amount of catalyst is supplied through the flexible hose 104 to the catalyst nozzle 54.

In the field of no-bake binders a number of resin-catalyst combinations have come into use with good results and these are especially well suited for the process and apparatus of the present invention. Organic binders may include furfuralcohol resins, alkyd resins, phenolic resins and others and inorganic binders may include solium silicate or water glass among others.

Furfuralcohol resins may be modified with urea and a typical example of this resin system would be as follows. For each 100 lb. quantity of silica sand (washed and containing 98% $SiO_2$, sieved #50–60 American Foundry Society screen size), the resin would normally be added in a ratio in the range of 1.1% to 2.0%, based on the weight of sand. A catalyst for the resin, such as phosphoric acid would be added in a ratio in the range of 30% to 45%, based on the weight of resin. Another catalyst such as sulphoric acid could be used in a ratio in the range of 20% to 35%, based on the weight of resin. Sulporic acid (called T.S.A.), although somewhat more expensive, can be used in lesser percentages than phosphoric acid and has the advantage that this catalyst burns out of the mold more completely leaving little, if any residual catalyst. The ratio of catalyst to resin effects the curing time and as more catalyst is used, curing is speeded up. For example, with a 33% catalyst to resin ratio (phosporic acid) in a typical mix, the average working time may be 30 minutes. By reducing the catalyst 5%, the working time is increased to 40 minutes or by increasing the catalyst 10%, the working time is shortened to 20 minutes. With the sand-resin-catalyst example as set forth, the pattern 18 and other working surface coming into contact with the mixture should be precoated with a suitable releasing agent. Before the application of the molding mixture onto the surface of the pattern, the mixing head of the pattern is coated with a release agent so that the pattern can be readily removed from the mold 20. One such releasing agent is marketed under the registered trademark ZIP-SLIP, LP-15 by Ashland Chemical Company of Cleveland, Ohio. With the resin system described, a stripping time of about 60 minutes results, when the sand is at ambient temperature of about 75° F. The Ashland Chemical Company Technical Bulletin Nos. 5401-1 and 5415 (incorporated herein by reference) describe in greater detail, the characteristics of the furfuralcohol resins and various catalysts.

Another resin system suitable for the present invention includes an alkyd resin with drier included and a catalyst of iso-cyanate. For each 100 lbs. of 50–60 A.F.S. washed silica sand of the Illinois type, resin is added in the ratio range of 1.2% to 2.1% based on the weight of sand. With this resin, a drier such as a lead or cobalt napthanate in the ratio of 0% to 10% based on the weight of resin is premixed. The resin and drier combination are introduced into the mixing head 12 through the upper nozzle 50 and a catalyst of iso-cyanate is used in the ratio range of 18% to 20%, based on the weight of the resin. Technical Data Bulletins 5408-2 and 5411-2 of Ashland Chemical Company describe other characteristics of this resin system and are incorporated herein by reference.

A suitable inorganic no-bake binder system employs sodium silicate in the ratio of about 3% based on sand and the catalyst used is glycerol acetate in the ratio range of 10% to 15% based on the weight of binder. This material provides a heavier more dense molding mixture when mixed with 50–60 A.F.S. washed silica sand. Again, the working and stripping times required may be adjusted by varying the ratio of catalyst to binder.

While the above described numerical control system may be programmed in accordance with conventional parts, programming techniques so that successive blocks of information in the tape 113 are effective to move the dispenser head 12 over a path which conforms generally to the contour of the pattern 18 during successive passes within the flask 14, in many instances it is desirable also to control the velocity with which the dispenser head 12 is moved along the programmed path defined by the X, Y and Z axes information on the tape 113. Thus, if it is assumed that an essentially constant volume of mixture is dispensed from the dispenser head 12, it may be desirable to move the dispenser head over its predetermined path at increased velocity so that the thickness of the layer deposited over the pattern is reduced for a particular pass over the entire flask or in a particular area of the pattern. In the alternative, it may be desirable to slow down movement of the dispenser head 12 in a particular area of the pattern so that with a constant sand-binder ratio the deposited layer will be built up in thickness in a particular area of the pattern to provide additional strength in this area.

In accordance with a further aspect of the present invention, numerical information is provided on the tape 113 to control the velocity of movement of the dispenser head over the predetermined path defined by the X, Y and Z axis information which is also provided on the tape. More particularly, the velocity number defined by the sub-block of information 140 is stored in the active storage register 116 and is converted to an analog signal by the converter 144 and is supplied as one input to a divider module 184. The other input to the divider 184 is the output signal 162 from the multiplier 160, which represents the volume of sand supplied to the dispenser head 12. The divider 184 develops an output signal in accordance with the ratio determined by the path velocity set point signal on the conductor 150 so that a signal which is a programmed percentage of the sand volume signal is developed on the output conductor 186 of the divider 184. The output signal 186 is supplied to a clock frequency control circuit 188, the output of which is supplied over the conductor 190, to the clock 120. Accordingly, the frequency of the pulses supplied to the linear interpolator 118 may be varied in accordance with the velocity number on tape 113.

This means that the rate at which the command pulses for all three axes are produced in response to a given numerical command on the tape 113 may be varied in accordance with the velocity number on the tape 113. The velocity with which the dispenser head 12 may be moved in a given area or for a complete pass over the flask 14 may thus be varied as desired by choosing the appropriate velocity code on the tape 113 in that particular area.

In many instances, it is desirable to add a predetermined percentage of wetting agent such as iron oxide to the initial layer deposited over the pattern so as to reduce sticking and also to provide a smoother surface on the metal casting which is produced during the casting process. In accordance with the present invention, such a wetting agent as iron oxide may be selectively added to the mixture during one or more passes over the flask 14 in a fully automatic manner. Different wetting agents can be used depending on the type of material being cast in the mold cavity. More particularly, an iron oxide storage hopper 192 is provided above the conveyor 42 at a point beyond the detector 152 and is provided with an on-off control 194 which is effective either to produce a predetermined flow of iron oxide onto the conveyor belt 42 or to be completely shut off. The tape 113 is also provided with a control number, which may be a single binary bit in the row following the sub-block 140, which is detected by one of the channels of the converter 144 and is employed to supply an on-off signal over the conductor 196 to the on-off control 194.

When a binary iron oxide on signal is provided on the tape 113, indicating that iron oxide is to be added to the sand-binder mixture, the on-off control 194 responds thereto by opening the hopper 192 a fixed, predetermined amount to add a predetermined percentage of iron oxide to the sand. Thus, if during the first pass over the pattern, it is desired to include iron oxide, the iron oxide on signal is provided in each block of information on the tape 113. In the alternative, a single control number could be provided on the tape 113 at the start of the first pass and the on-off control 194 could be set to the on position when this control number is detected by the tape reader 112. At the end of the first pass, or whenever it is desired to shut off the hopper 192, another control number could be provided at the appropriate point on the tape 113 and the on-off control would respond to this second number by closing the hoppoer 192. Such an arrangement avoids programming an iron oxide number on the tape for each block of information.

In accordance with an important aspect of the present invention, the automatic control system is arranged automatically to shift over from an organic binder and catalyst to an inorganic binder and catalyst at any desired point in the mold forming process. Such an arrangement has the advantage that an initial thin layer or organic binder and catalyst may be initially deposited over the pattern 18 and then subsequent layers may be deposited over the initial layer using an inorganic binder and catalyst. When a mold is formed in this manner, the relatively thin layer containing an organic binder, which is next to the molten metal during the casting process, is completely oxidized and burned up and produces relatively little smoke and fumes in the process. The inorganic binder which constitutes the remaining portion of the mold does not oxidize and hence, the overall casting process produces much less noxious gases and fumes and is therefore much more desirable from an air pollution standpoint.

To accomplish this objective, an inorganic binder storage tank 200 is provided and supplies an inorganic binder such as sodium silicate (water glass) to a variable volume pump 202. An inorganic catalyst storage tank 204 is also provided which supplies a diluted inorganic acid which acts as an inorganic catalyst, to a variable volume pump 206. The output of the pump 202 is supplied to an inorganic binder injection nozzle 208 through a suitable check valve, the nozzle 208 corresponding to the injection nozzle 50, which is used to introduce an organic binder, but is positioned at a different location around the periphery of the mixing chamber 22. The output of the variable volume pump 206 is supplied to a suitable inorganic catalyst injection nozzle 210 which is positioned diametrically opposite the organic catalyst injection nozzle 54. Suitable flow meters 212 and 214, which correspond to the flow meters 170 and 180, are employed to provide feedback signals for the flow controllers associated with the variable volume pumps 202 and 206.

In order to automatically control the changeover from an organic binder and catalyst flow to the inorganic binder and catalyst, suitable information is provided on the tape 113 to control this changeover. For example, the binary number corresponding to the row identified as "a" in sub-block 136 may have a first designation "a-1" when an organic binder is to be used and a second representation "a-2" when an inorganic binder is to be used. The remaining three rows of information in the sub-block 136 will then provide the numerical value of the set point for either the organic binder or the inorganic binder.

A similar designation can be made by means of the row of holes identified as "b" in sub-block 138 to identify either an organic catalyst (b-1) or an inorganic catalyst (b-2). The remaining three rows of information in sub-block 138 will then provide the set point value with either the organic catalyst or the inorganic catalyst.

Figure 7A:
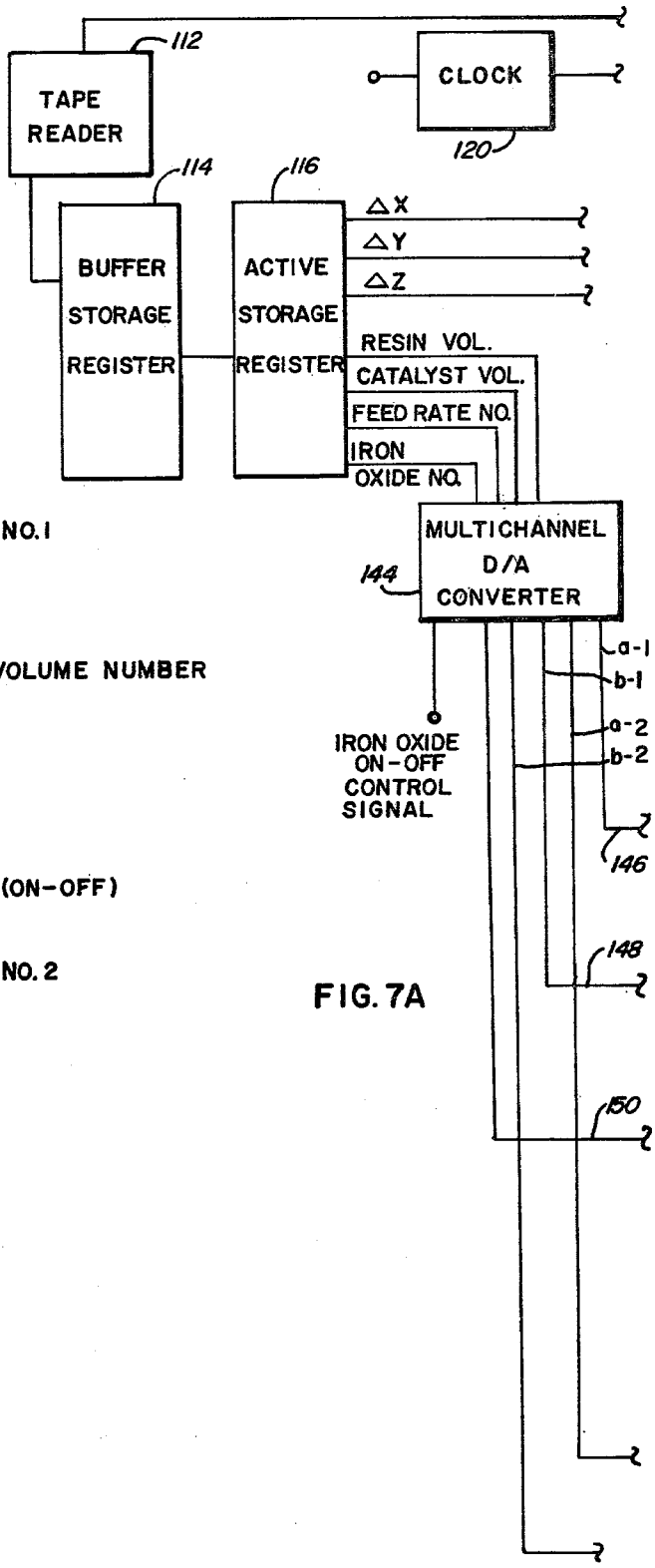
FIGS. 7A and 7B comprise a block diagram of the tape controlled automatic control system of the present invention with the process control portion thereof shown in more detail than in FIG. 3.
Figure 7B:
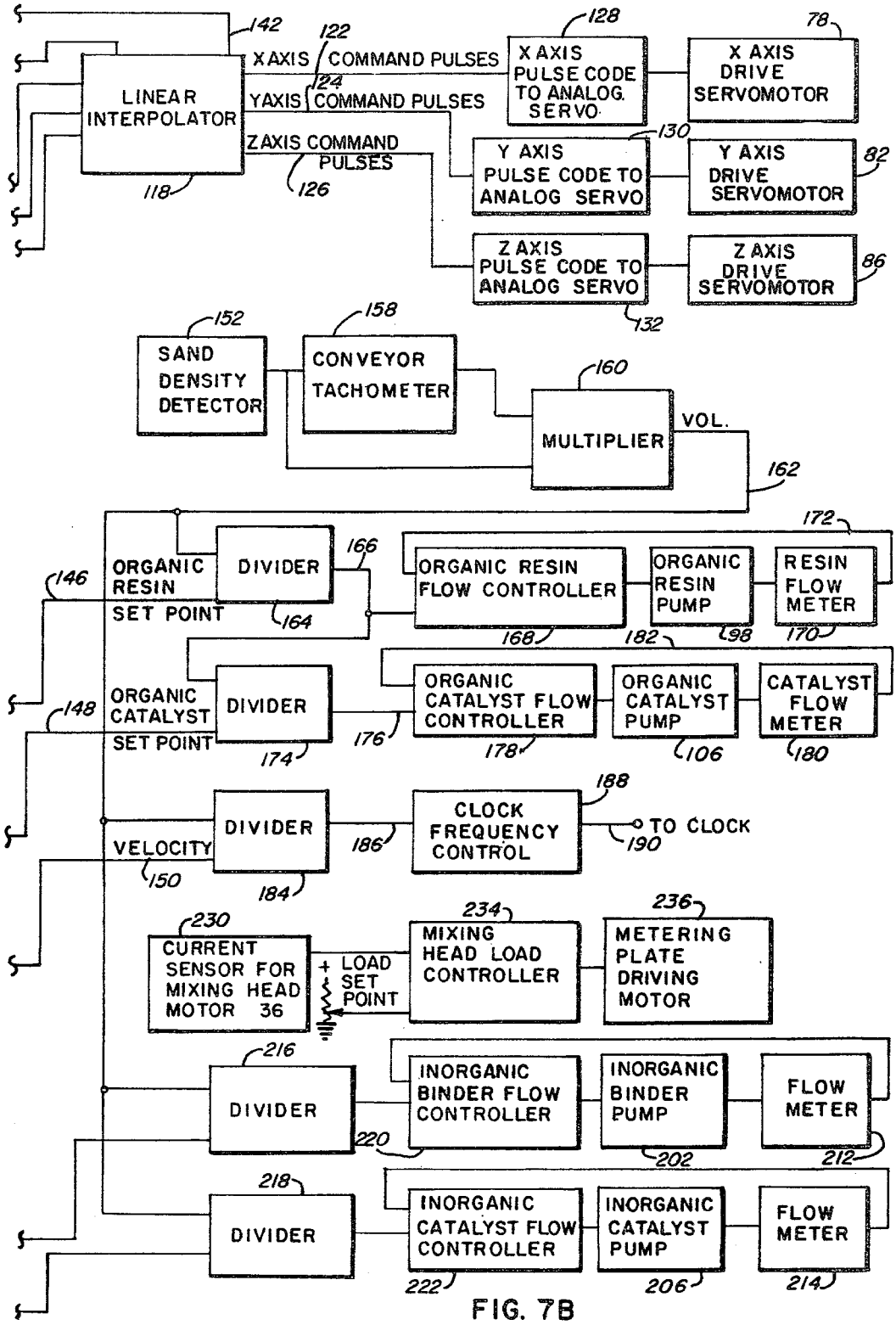

The digital-to-analog converter 144 is provided with separate channels for the different a-1, a-2, b-1 and b-2 values as shown in FIG. 7. The inorganic binder and inorganic catalyst set point values are supplied respectively to the dividers 216 and 218 to which the sand velocity signal on the conductor 162 is also supplied as a second input.

The output of the divider 216 is supplied to an inorganic binder flow controller 220 which controls the inorganic binder pump 202, and the output of the divider 218 is supplied to an inorganic catalyst flow controller 222 which controls the pump 206. The inorganic binder and catalyst controllers 220 and 222 function in a manner described heretofore in connection with resin flow controller 168 and catalyst flow controller 178 and hence a detailed description need not be included herein.

In operation, if an organic resin and catalyst are to be used, the a-1 and b-1 lines of the converter 144 will supply set point information to the dividers 164 and 174 while the lines a-2 and b-2 provide disabling inputs to the dividers 216 and 218 so that the pumps 202 and 206 are closed. Accordingly, during the first initial pass over the pattern 18 the organic binder and catalyst are mixed with the sand and deposited on the pattern. If it is desired to use an inorganic binder and catalyst for the remaining passes over the pattern, the a and b rows of information in the sub-blocks 136 and 138 will contain the a-2 and b-2 codes respectively, so that the converter 144 supplies set point information to the dividers 216 and 218 while disabling inputs are supplied to the dividers 164 and 174. The inorganic binder and catalyst from the tanks 200 and 204 are then mixed with the sand for the remaining passes during the mold forming operation. It is also pointed out that regardless of whether an organic or an inorganic binder is being used, the ratio of binder to sand may be varied at predetermined locations over the pattern by appropriate variation in the set point value on the tape 113 at these locations.

If it is desired to maintain a constant ratio of binder and catalyst to sand for either the organic binder or the inorganic binder will be appreciated that a single sub-block of information corresponding to the sub-blocks 136 and 138 can be employed at the start of a particular pass during which it is desired to use either an organic binder or an inorganic binder, thus eliminating the necessity for including the sub-blocks 136 and 138 with each block of information on the tape 113. However, when only one initial sub-block of information is employed to control the selection of organic or inorganic binder and to fix the sand-binder ratio for the remainder of the pass, it will be necessary to hold the organic or inorganic set point value in the active storage register 116 for the duration of the pass during which this set point value is to control the mixing operation. This can be done by providing suitable flip-flops in the channels in the active storage register 116 corresponding to the sub-blocks 136 and 138, as will be readily understood by those skilled in the art.

When the mixing operation is initially started, it is necessary to first provide a sufficient volume of sand in the mixing chamber 22 to obtain good mixing action. To this end, the metering plate 52 is arranged to be initially closed off. As sand pours into the mixing chamber 22 from the conveyor 42, the driving motor 36 will have an increased load on it as it moves an increasing volume of sand within the chamber 22. As the load on the motor 36 increases, the current drawn from the power source will also increase and can be used as a feedblack signal to control movement of the metering plate 52 to an average open position.

More particularly, a current sensor 230 is connected in one of the three phase power lines to the driving motor 36 and produces an output signal proportional to the current drawn by the motor 36 and hence, the amount of sand and binder combination rotated by this motor in the mixing chamber 22.

A load set point potentiometer 232 (FIG. 7) is employed to establish a fixed set point signal corresponding to a desired load condition within the mixing chamber 22, this set point signal being supplied to a mixing head load controller 234.

The output of the controller 234 is supplied to a metering plate driving motor 236 (FIG. 3) which functions through a suitable gear reduction mechanism to drive the pinion gear 59 (FIG. 2B) and hence, produce rotation of the metering plate 52. The output of the current sensor 230 is also supplied to the load controller 234 as the input variable.

When there is no load on the mixing head motor 36 and the current sensor 230 produced a relatively low output signal the controller 234 is arranged to control the motor 236 so that the metering plate 52 is closed. However, as sand builds up in the mixing chamber 22 and the load on the mixing head motor 36 increases, the signal developed by the current sensor 230 will approach the set point signal determined by the setting of the potentiometer 232 so that the metering plate 52 will be moved to an open or mid position.

Small variations in the flow of sand into the chamber will then be compensated by the controller 234 since these small variations in load will produce corresponding changes in the output of the current sensor 230 with respect to the set point established by the potentiometer 232. The controller 234 thus operates to maintain an essentially constant flow of sand, binder and catalyst mixture from the dispensing head 12. However, it should be pointed out that major changes in the flow of sand into the mixing chamber 22, which may be due to changes in the speed of the conveyor, may necessitate re-adjustment of the potentiometer 232 to give an appropriate mid-point value about which the controller 234 can operate.

In accordance with the invention, a mold 20 having plural layers **20*a*, 20*b*, 20*c* etc., may be automatically produced with the inner layer 20*a* having an organic type binder dimensioned with a thickness and having a sand-binder ratio such that substantially all of the binder in the layer 20*a* is completely oxidized or burned out by the heat from the molten material in the mold cavity. The layers 20*b*, 20*c*, etc., may be formed with an inorganic binder and accordingly, the molding process contributes little if any to common pollution problems wherein an organic binder residue remains in the mold or wherein an organic binder is not completely but only partially oxidized or burned out in the casting process. In addition, sand reclamation of the molds 20 is much more economical then heretofore possible with no-bake binders because of the fact that a substantially complete burn out of the organic binder occurs with little or no residual binder and the remaining inorganic binder of the outer layers 20*b*, 20*c*, 20*d***, etc. can be subjected to economical reclamation processes.

Moreover, mold of the type just described, can be economically produced and in addition, a wetting agent such as iron oxide (per gray iron castings) can be intermixed and applied only with the inner layer **20*a*** to provide a better surface on the casting and little, if any, sticking between the mold and the casting produced. In prior systems, it was practically impossible or at least very difficult to use two different binder systems in a single mold with any control and similarly, if a wetting agent was used, it was usually a practical necessity to simply add the iron oxide to the entire batch of molding sand used in the mold even though the iron oxide was only needed at the wall surface of the cavity coming into direct contact with the molten metal.

Although the present invention has been described with reference to several illustrative embodiments thereof, it should be understood that numerous other modifications and embodiments can be devised by those skilled in the art that will fall within the spirit and scope of the principles of this invention.

What is claimed as new and desired to be secured by Letters Patent of the United States is:

1. A mixing device for dispensing a mixture of molding sand and a resin binder system onto a mold forming pattern comprising:

a mixing chamber having an inlet for receiving sand adjacent an upper level and a discharge outlet for said mixture adjacent a lower end, a rotor mounted in said chamber including an upstanding rotating shaft extending between said inlet and said outlet and a plurality of radially extending mixing elements carried for rotation with said shaft, means for injecting binder into said chamber between said inlet and outlet for intimate mixing with said sand moved around said shaft by said mixing elements, said injecting means including a first conduit for injecting a first component of a resin binding system adjacent a first portion of said chamber and a second conduit for injecting a second component of a resin binder system intermediate the level of said first injecting conduit and said outlet of said chamber, and adjustable flow control means between said first and second conduits dividing said chamber into first and second sections for controlling the flow of intermixed sand and said first component therebetween.

2. The mixing device of claim 1 wherein said shaft is vertically disposed in said chamber and said mixing elements include means for retarding the downward flow of sand from said inlet toward said outlet while said resin binder system is intermixed therewith.

3. The mixing device of claim 1 including means supporting said chamber for selectively controlled movement along horizontal axes at right angles to each other.

4. The mixing device of claim 1 including control means for selectively controlling the ratio of sand and binder introduced into said mixing chamber in response to the position of said chamber in relation to said mold forming pattern.

5. A continuous mixer for dispensing a mixture of molding sand and resin binder system onto a mold forming pattern comprising:

a mixing chamber having an inlet adjacent a first portion for receiving sand, means for introducing a first component of a resin binder system into said first portion, means in said first portion for mixing said sand and said first component, a scond portion of said mixing chamber having a discharge outlet for said mixture of sand and resin binder system, means for introducing a second component of said resin binder system into said second portion, means in said second portion for mixing said second component and said mixture of sand and said first component received from said first portion, and p1 means for selectively controlling a flow of intermixed sand and said first component from said first portion into said second portion of said chamber for mixing with said second component therein.

6. The continuous mixer of claim 5 wherein said flow controlling means is operable between a shut-off condition preventing flow from said first portion into said second portion and an open position permitting said flow.

7. The continuous mixer of claim 5 wherein said first portion is above said second portion and said discharge outlet is positioned adjacent a lower level of said second portion.

8. The continuous mixer of claim 7 wherein said flow controlling means comprises an orfice forming means of variable flow area separating said first and second portions of said mixing chamber.

9. The continuous mixer of claim 8 wherein said orfice forming means comprises a first orfice plate having at least one flow passage and a relative movable second orfice plate having at least one flow passage and means for moving said second orfice plate between positions wherein the respective flow passages are aligned and misaligned to control the effective cross-sectional area of flow between said first and second chamber portion.

10. The continuous mixer of claim 9 wherein said orfice plates comprise a pair of coaxially mounted circular disks having radial flow passage defined therein and means for rotating one disk relative to the other for selectively controlling alignment and misalignment between said flow passage.

11. The continuous mixer of claim 5 wherein said first and second chamber portions are vertically spaced apart on opposite sides of said flow controlling means.

12. The continuous mixer of claim 11 wherein said mixing means in said first and second portions includes a common vertical drive shaft coaxially aligned with chamber and passing through said flow controlling means.

13. The continuous mixer of claim 12 wherein said mixing means in said first portion includes a plurality of vertically spaced radial mixing elements mounted on said shaft.

14. The continuous mixer of claim 12 wherein said mixing means in said second portion includes at least one radial mixing element secured adjacent an inner end to pivot about an axis running in the same direction as said shaft.

15. The continuous mixer of claim 14 wherein said mixing element includes an outer end portion adapted to squeeze material in said second portion of said mixing chamber outwardly against a wall portion thereof.

16. The continuous mixer of claim 15 wherein said second portion of said mixing chamber includes at least one wall section of a diameter larger than said first portion below said catalyst introduction means.

* * * * *